US005140292A

United States Patent [19]

Aronow

[11] Patent Number: 5,140,292

[45] Date of Patent: Aug. 18, 1992

[54] ELECTRICAL COIL WITH OVERLYING VITRIFIED GLASS WINDING AND METHOD

[75] Inventor: Martin L. Aronow, Pennsauken, N.J.

[73] Assignee: Lucas Schaevitz Inc., Pennsauken, N.J.

[21] Appl. No.: 656,442

[22] Filed: Feb. 19, 1991

[51] Int. Cl.[5] ..... H01F 27/30; H01F 41/04

[52] U.S. Cl. ..... 336/205; 29/605; 174/122 G; 174/124 G; 310/45; 310/208; 335/299; 336/206; 336/222

[58] Field of Search ..... 174/122 G, 124 G; 310/208, 45; 335/282, 299; 336/205, 206, 209, 199; 29/605, 606; 336/222, 136

[56] References Cited

U.S. PATENT DOCUMENTS

| | | | |
|---|---|---|---|
| 3,223,553 | 12/1965 | Morey | 336/205 X |
| 3,389,458 | 6/1968 | Ostrander et al. | 336/205 X |
| 3,842,193 | 10/1974 | Johnson | 336/205 X |
| 4,694,268 | 9/1987 | Kawamura et al. | 335/216 |
| 4,818,909 | 4/1989 | Balke | 336/206 X |
| 4,853,565 | 8/1989 | Elton et al. | 310/45 |

FOREIGN PATENT DOCUMENTS

| | | |
|---|---|---|
| 48-880 | 4/1982 | European Pat. Off. . |
| 081154 | 6/1983 | European Pat. Off. . |
| 109-896 | 5/1984 | European Pat. Off. . |
| 3805636 | 9/1989 | Fed. Rep. of Germany . |
| 55-143005 | 11/1980 | Japan . |
| 60-84937 | 5/1985 | Japan . |

*Primary Examiner*—Thomas J. Kozma
*Attorney, Agent, or Firm*—Nixon & Vanderhye

[57] ABSTRACT

A coil has one or more layers of primary and secondary windings about a bore liner, with the primary and secondary windings separated by a winding of glass threads. The coil is heated in an oven to first drive off the volatiles of the binder forming part of the ceramic insulation for the primary and secondary coils and which volatiles pass through the winding of glass thread. The coil is further heated so that portions of the glass fibers forming the threads vitrify with the non-vitrified remaining portions retaining their well-defined, discrete fiber characteristics, whereby they extend through the vitrified glass to seal the coil, reinforce the coil against vibration and shock, and enable a dimensionally compact coil.

16 Claims, 2 Drawing Sheets

ELECTRICAL COIL WITH OVERLYING VITRIFIED GLASS WINDING AND METHOD

BACKGROUND AND SUMMARY OF THE INVENTION

The present invention relates to an electric coil with an overlying vitrified glass winding and method of making the coil and particularly relates to linear variable differential transformers, electric coils, e.g., for use in environments where temperatures range between very high and cryogenic temperature extremes and intense nuclear radiation is extant, and methods of fabricating the coils.

Currently, electric coils, e.g., linear variable differential transformers (LVDT) have been manufactured for use under extreme environmental conditions, for example, in temperature conditions ranging from liquid nitrogen to 650° C. and radiation levels represented by a total integrated flux of $3\times10^{20}$ NvT. These devices are fabricated of inorganic materials, i.e., ceramics and metals, to avoid the degradation that organic materials experience from high temperature and radiation. Recent refinements in materials and manufacturing technologies have resulted in acceptable products for most applications in these extreme environmental conditions.

However, most such devices have only a very limited life cycle, particularly when subjected to rapid and frequent temperature cycling, combined with severe vibration and shock. Current practice involves winding the coils of the LVDT with a precious metal alloy magnet wire insulated with ceramic insulation. The wire is then cured and heated to a temperature sufficient to drive off the organic binder and cause the ceramic particles of insulation to bond. The magnet wire itself is held in place by application of ceramic cement. The coil thus fabricated is vulnerable, however, to humidity and other moisture. It is also highly fragile due to its relatively low strength and brittleness. Conventionally, such LVDTs are protected by welding them into hermetically sealed housings.

Recent development work in this technology has focussed on coating the cured magnet wire with a first material, i.e., a clay, to overcoat the magnet wire with an insulating ceramic coating free of lead or lead oxide to prevent interaction of the coating and the metal of the magnet wire. A second coating is also applied over the first coating and is intended, upon curing, to produce a moisture-resistant coating. While these techniques can be utilized, the fabricating process requires substantial attention and time because three steps of temperature processing are required, necessitating three controlled heating and cooling steps. The resulting product, however, suffers additionally because of potential spontaneous fracture due to stress created by the difference in coefficients of expansion of the various materials.

According to the present invention, there is provided a coil, for example, a linear variable differential transformer, and a process for fabricating the coil wherein the coil itself is protected against moisture, resists vibration and shock and is more dimensionally compact. Additionally, the process for fabricating the coil comprises a one-step heating process in lieu of multiple heating steps and other processing used previously. Particularly, the coil hereof includes a winding formed of electrically conductive material, such as palladium-silver, with a ceramic insulating material thereabout.

One or more layers of glass thread, each comprised of a plurality of spirally wound glass fibers, are wound about the layer or layers of the coil winding. By heating the wound coil, its component parts pass through temperature stages which first enable the organic vapors of the ceramic insulating material on the electrically conductive winding to be released and infiltrate out through the wound glass thread, i.e., between its windings. When the ceramic insulation material has been cured, the coil is further heated to a predetermined temperature corresponding generally to the vitrification temperature of the glass thread. The temperature is held at the vitrification temperature until a portion of the glass thread becomes vitrified as a common mass, while another portion of the glass thread remains as discrete, well-defined, non-vitrified fibers. After cooling, the non-vitrified fibers in the mass of vitrified fibers reinforce the latter about the conductive winding.

More particularly, by properly controlling the temperature and time extant at such temperature, portions of the glass fibers may vitrify, while others remain non-vitrified, forming, in essence, non-vitrified discrete reinforcing fibers for the mass of vitrified fibers. It will be appreciated, of course, that the winding of electrical conductive material may comprise one or more layers, while, similarly, the overlay of glass threads may likewise comprise one or more layers. Additionally, a second or secondary winding of electrically conductive material may be provided about the first layer of glass threads and the underlying first or primary electrical windings, with a second layer of glass threads wound about the secondary layer of electrically conductive material. Thus, two layers of glass threads, each being partially vitrified and having no-vitrified discrete well-defined glass fibers extending through and reinforcing the vitrified glass fibers, may overlie the discrete windings of electrically conductive material.

In another embodiment of the present invention, the fibers of the glass thread may have different vitrification temperatures. In this embodiment, the temperature of the coil may be raised during fabrication to the vitrification temperature of one of the fibers, while remaining below the vitrification temperature of the other fiber or fibers in the glass threads. Thus, the glass fiber having the lower vitrification temperature vitrifies while the remaining glass fibers remain non-vitrified, forming discrete well-defined reinforcing fibers extending through the mass of vitrified fibers.

According to the present process, the winding is thus covered by a partially vitrified glass thread winding which protects against ingress of moisture and resists vibration and shock because of the reinforcing capacity of the non-vitrified glass thread portion or fibers thereof. Additionally, the cost of manufacture is substantially reduced because only a single heat treatment processing step is needed, rather than multiple steps at different temperatures. Further, the layers of glass thread afford a very thin coating about the windings and hence form a compact coil.

While the present invention is particularly useful for linear variable differential transformers, particularly those which are subjected to wide cyclical temperature changes and radiation, the process is equally applicable to coil devices which require a combination of protection against moisture, high temperature, performance and radiation resistance such as inductive half bridge coils, ordinary inductors or transformers, toroids or the like.

In a preferred embodiment according to the present invention, there is provided an electrical coil comprising a winding of at least one layer of electrically conductive material, at least one layer of a glass thread wound about the one layer of electrically conductive material and a first portion of the one layer of glass thread being vitrified and a second portion thereof being non-vitrified to reinforce the vitrified glass layer portion.

In a further preferred embodiment according to the present invention, there is provided a method of forming an electrical coil comprising the steps of winding at least one layer of electrically conductive material about a form, winding at least one layer of a glass thread about the one layer of electrically conductive material, controllably heating the coil to a predetermined temperature such that a first portion of the glass thread is vitrified and retaining a second portion of the glass thread in a non-vitrified state whereby, after heating the coil, the non-vitrified portion reinforces the vitrified portion.

Accordingly, it is a primary object of the present invention to provide a novel and improved electrical coil and method of fabrication thereof which enables a coil for use in environments subject to wide cyclical temperature changes and temperature extremes, as well as radiation, the coil having substantial shock, vibration and moisture resistance characteristics and a complete seal thereabout and wherein the process requires only a single heat treatment step.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
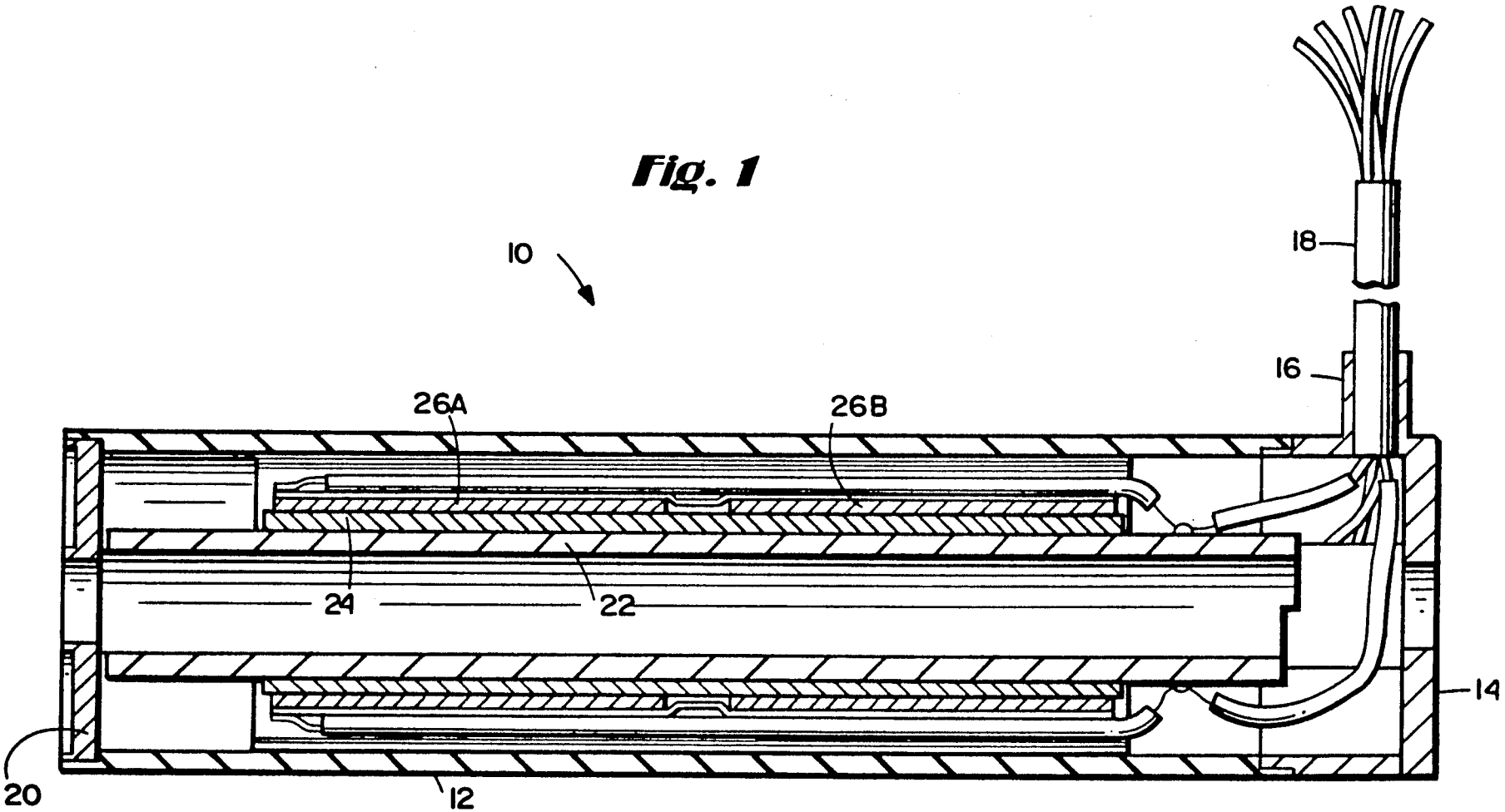
FIG. 1 is a longitudinal cross-sectional view through an electric coil, e.g., linear variable differential transformer, according to the present invention.

Referring now to the drawings, particularly to FIG. 1, there is illustrated an electrical coil according to the present invention, in this case, a linear variable differential transformer, generally designated 10. The transformer 10 includes a generally cylindrical housing 12 having an end cap 14 adjacent one end, and a nipple 16 on end cap 14 for receiving sheathed cables 18 constituting the leads for the transformer. The opposite end of cylindrical housing 12 is provided with an annular disk-like end cap 20. Within cylindrical housing 12, there is provided a bore liner 22 about which is wound the primary secondary windings and glass thread of the present invention and within which there is provided a core, not shown, forming an integral part of the transformer. The construction of a linear variable differential transformer is well known and details of the transformer and its operation are therefore not set forth herein. It will be appreciated, however, that the transformer 10 has primary and secondary windings, designated 24 and 26A and 26B, respectively, connected to the leads substantially as illustrated. The primary and secondary windings are formed preferably of an electrically conductive material, such as palladium-silver which is an alloy of approximately 25% palladium and 75% silver, known as Alloy 406. Each of the primary and secondary windings may comprise one or more layers of windings and, in the form of the invention illustrated in FIG. 2, three layers each of primary and secondary windings are depicted. Each of the primary and secondary windings is also coated with a ceramic insulating material 27, typically including a lubricant and a binder, the insulating material being designated 28 in FIG. 3A. The insulating material is approximately 0.002 inch thick on the electrical winding.

Figure 2:
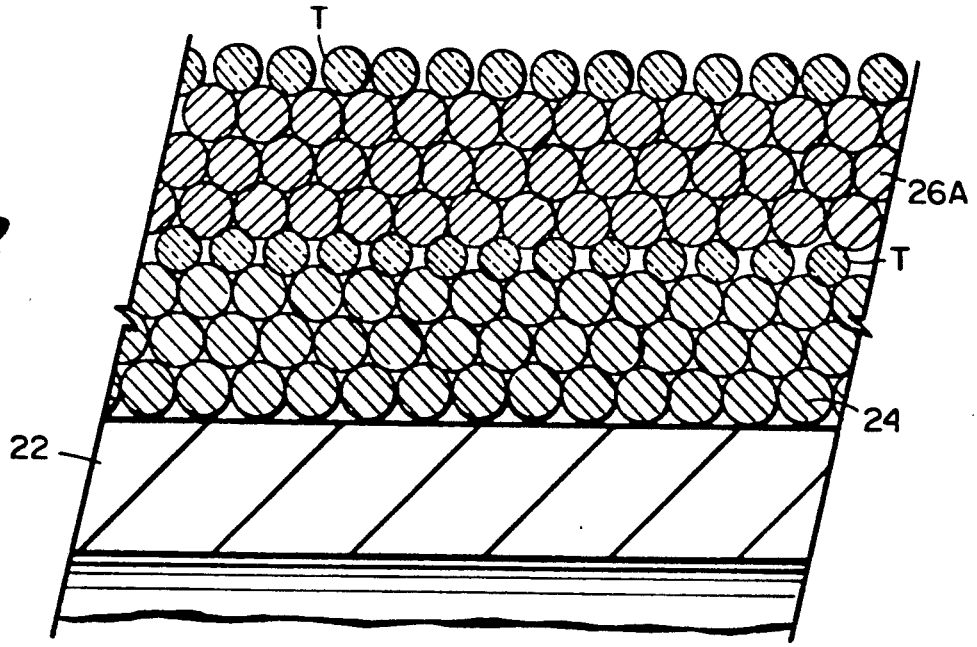
FIG. 2 is an enlarged fragmentary cross-sectional view illustrating the bore liner of the transformer with primary and secondary windings, together with glass thread windings therebetween.

As best illustrated in FIG. 2, the one or more layers of primary windings 24 are segregated and insulated from the one or more layers of the secondary windings 26A or 26B by one or more layers of a winding formed of a glass thread T. The glass thread is comprised of a plurality of glass fibers 30 spirally wound one about the other to form the thread. The glass thread T may be of the type referred to as Fiberglass Thread manufactured by Atkins/Pearce under manufacturing part No. ECG150-3/3-3.865. The glass thread T is provided with a known vitrification temperature for the glass fibers of the thread. Thus, when the one or more layers of glass thread is wrapped about the primary coil, as well as the secondary coil, as illustrated in FIG. 2, the glass fibers 30 comprising the thread are spirally wrapped one about the other and about the electrical coil windings. The wrappings of the electrical coil and glass threads are performed in a conventional manner using known techniques and machines.

Figure 3A:
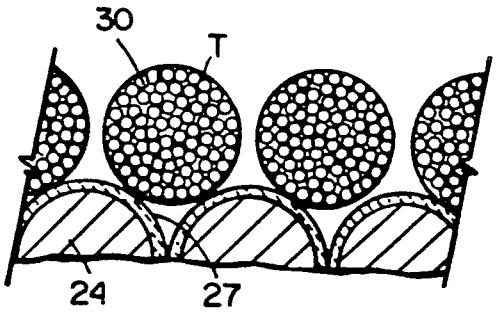
FIGS. 3A and 3B are enlarged cross-sectional views illustrating the glass threads before and after heat treatment in the oven as illustrated in FIG. 4.
Figure 3B:
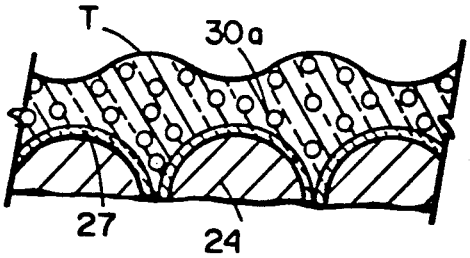
Figure 4:
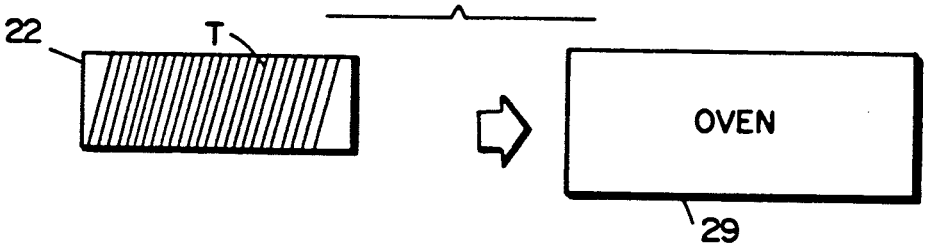
FIG. 4 is a schematic representation of the heat treatment process according to the present invention.

When the bore liner has been wrapped with the electrical coil and glass insulating threads, it is subjected to a single heat treatment, as schematically illustrated in FIG. 4. Thus, the windings and the bore liner are disposed in an oven 29 and the temperature of the oven is elevated. It will be appreciated that at a predetermined temperature, for example, on the order of 500° C., the organics of the ceramic insulation material 28 vaporize and escape or egress from the windings and infiltrate through the glass threads, i.e., the spaces between the threads and fibers. As the temperature of the oven is raised further, the vitrification temperature of the glass fibers is reached. For example, the temperature may reach a temperature of approximately 600° C., at which vitrification of some of the glass fibers commences. Through proper control of the temperature and residence time of the glass thread winding in the oven at about the vitrification temperature, a portion of the glass fibers of the glass thread may be vitrified, while remaining portions of the glass fibers of the same thread remain in a non-vitrified state. This is illustrated upon comparison of FIGS. 3A and 3B. In FIG. 3A, there is illustrated the discrete, well-defined glass fibers 30 of a glass thread T in juxtaposition with the ceramic-coated electrical wire 24 prior to vitrification in oven 29. In FIG. 3B, there is illustrated the state of the glass fibers of the glass thread after a portion of the fibers 30 have been vitrified but prior to vitrification of any of the remaining glass fibers. Thus, the remaining non-vitrified glass fibers 30*a* form discrete, well-defined fibers extending through the mass of glass formed by vitrification of the first-mentioned glass fibers and which non-vitrified fibers reinforce the mass of vitrified fibers. The vitrification of the first portion of the glass fibers also coalesces with the mass of adjacent glass threads to form a seal about the electric coil, as illustrated in FIG. 3B. The vitrifying glass fiber portions also coalesce about the outer portions of the electric coil, effecting stabilization of those coils in final assembly. Once the appropriate vitrification temperature and residence time for the first portion of the glass fibers has been achieved, the coil and bore liner are removed from the oven and cooled. Consequently, the non-vitrified glass fibers form discrete well-defined reinforcing elements which pass through the mass of vitrified fibers.

It will be appreciated that the glass fibers forming each glass thread may have different dimensional characteristics whereby the residence time necessary to effect vitrification of one fiber is different than the residence time necessary for vitrification of another fiber. In this manner, glass fibers identical to one another, except for diameter, require different residence times in the oven to effect vitrification whereby control over the vitrification of some fibers and the non-vitrification of other fibers can be obtained. Additionally, the glass fibers forming the glass thread may be formed of different glass fibers having different vitrification temperatures. This facilitates control of the vitrification of only a portion of each glass thread and without regard to residence time in the oven. For example, the vitrification temperature of one set of glass fibers may be 5° to 10° lower than the vitrification temperature of another set of glass fibers. By controlling the temperature of the oven to a predetermined temperature higher than the vitrification temperature of the first set of glass fibers but below the vitrification temperature of the second set of glass fibers, the first set may be melted into a mass of glass, while the second set will remain in their discrete, well-defined fiber form and extend through the mass of vitrified glass.

Accordingly, the objects of the present invention are fully accomplished in that the glass thread winding having non-vitrified fibers for reinforcing the mass of vitrified glass, thus enabling the coil to withstand shock and vibration, sealing the windings against moisture and enabling a more compact structure, since the layers of glass thread after vitrification are thinner than the layers of the ceramic previously required by one of the earlier embodiments. Additionally, the single-step manufacturing process eliminates the multiple steps of the prior art, while still enabling the vapors from the wire insulation to escape through the glass threads before the coils are sealed by the vitrification of the glass.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An electrical coil comprising:

a winding of at least one layer of electrically conductive material;

at least one layer of a glass thread wound about said one layer of electrically conductive material;

a first portion of said one layer of glass thread being vitrified and a second portion thereof being non-vitrified to reinforce the vitrified glass layer portion.

2. A coil according to claim 1 wherein said winding lies about an axis and has a discrete longitudinal extent in the direction of said axis, said one layer of glass thread having a discrete longitudinal extent in the direction of said axis, said non-vitrified and vitrified glass layer portions lying substantially uniformly along said one layer of glass thread throughout its longitudinal extent.

3. A coil according to claim 1 wherein said one layer of electrically conductive material comprises a precious metal magnet wire.

4. A coil according to claim 1 wherein said glass thread is free of lead and lead oxide.

5. A coil according to claim 1 wherein each of said electrically conductive material and said glass thread are wound in multiple layers thereof, respectively.

6. A coil according to claim 1 including a second layer of electrically conductive material overlying said one layer of glass thread, a second layer of a glass thread overlying said second layer of electrically conductive material, a first portion of said second layer of glass thread being vitrified and a second portion of said second layer of glass thread being non-vitrified to reinforce the vitrified second glass layer portion.

7. A coil according to claim 1 wherein said one glass thread including first and second glass fibers having different vitrification temperatures, respectively, said vitrified first glass layer portion constituting said first glass fibers and the non-vitrified first glass layer portion constituting said second glass fibers having a higher vitrification temperature than said first glass fibers.

8. A coil according to claim 1 wherein said winding of electrically conductive material comprises an alloy of palladium and silver.

9. A coil according to claim 1 wherein said winding lies about an axis and has a discrete longitudinal extent in the direction of said axis, said one layer of glass thread having a discrete longitudinal extent in the direction of said axis, said non-vitrified and vitrified glass layer portions lying substantially uniformly along said one layer of glass thread throughout its longitudinal extent, said one layer of electrically conductive material comprising a precious metal magnet wire and said glass thread is free of lead and lead oxide.

10. A coil according to claim 1 wherein said vitrified portion of said one layer of glass thread forms a seal about said winding of electrically conductive material.

11. A coil according to claim 1 wherein said non-vitrified second portion of said glass thread defines discrete well-defined glass fibers extending through the mass of the vitrified glass of said first portion of said one layer of glass thread.

12. A method of forming an electrical coil comprising the steps of:

winding at least one layer of electrically conductive material about a form;

winding at least one layer of a glass thread about said one layer of electrically conductive material;

controllably heating the coil to a predetermined temperature such that a first portion of the glass thread is vitrified; and retaining a second portion of the glass thread in a non-vitrified state whereby, after heating the coil, the non-vitrified portion reinforces the vitrified portion.

13. A method according to claim 12 including winding a second layer of electrically conductive material about said first layer of glass thread and winding a second layer of glass thread about said second electrically conductive layer of material and wherein the step of heating the coil includes heating to a predetermined temperature such that a first portion of said second layer of glass thread is vitrified and retaining a second portion of the glass thread in a non-vitrified state, whereby, after heating the coil, the non-vitrified portion of said second layer of glass thread reinforces the vitrified portion thereof.

14. A method according to claim 12 including the step of providing first and second glass fibers of said glass thread wherein said first fiber has a vitrification temperature lower than the vitrification temperature of said second fiber, the step of heating the coil to a predetermined temperature including heating said first glass fiber to its vitrification temperature and precluding heating said second glass fiber to its vitrification temperature whereby the second non-vitrified glass fibers reinforce the vitrified mass of first glass fibers.

15. A method according to claim 12 wherein the electrically conductive material has an outer layer of ceramic insulation with an organic binder, and wherein the step of heating includes heating the ceramic insulation to a temperature lower than the vitrification temperature of said first glass thread portion to drive off the organic vapors through the windings of the glass threads.

16. A method according to claim 12 wherein the step of heating includes heating the first portion of the glass thread such that the vitrification thereof is sufficient to seal the one layer of electrically conductive material against ingress of moisture.

* * * * *